US011267107B2

(12) United States Patent
Shih

(10) Patent No.: US 11,267,107 B2
(45) Date of Patent: Mar. 8, 2022

(54) RATCHET SOCKET

(71) Applicant: Neng-Chia Shih, Changhua (TW)

(72) Inventor: Neng-Chia Shih, Changhua (TW)

( * ) Notice: Subject to any disclaimer, the term of this patent is extended or adjusted under 35 U.S.C. 154(b) by 170 days.

(21) Appl. No.: 16/688,321

(22) Filed: Nov. 19, 2019

(65) Prior Publication Data

US 2020/0282527 A1 Sep. 10, 2020

(30) Foreign Application Priority Data

Mar. 7, 2019 (TW) ..... 108107646

(51) Int. Cl.
*B25B 13/46* (2006.01)

(52) U.S. Cl.
CPC ..... *B25B 13/461* (2013.01)

(58) Field of Classification Search
CPC ..... B25B 13/46–468; B25B 13/06; B25B 13/065
USPC ..... 81/60–63.2, 121.1, 186
See application file for complete search history.

(56) References Cited

U.S. PATENT DOCUMENTS 2,651,230 A * 9/1953 Waterval ..... B25B 13/06 81/124.3
4,836,067 A * 6/1989 Rogers ..... B25B 13/06 81/125
5,832,792 A * 11/1998 Hsieh ..... B25B 27/18 81/124.6
6,668,686 B1 * 12/2003 Hsien ..... B25B 13/04 81/119
7,024,967 B1 * 4/2006 Cheng ..... B25B 13/04 81/119
7,168,347 B2 * 1/2007 Hsieh ..... B25B 13/04 81/120
7,661,339 B2 * 2/2010 Wu ..... B25B 27/18 81/186
8,056,449 B2 * 11/2011 Hsieh ..... B25B 13/065 81/121.1
8,869,660 B2 * 10/2014 Hsieh ..... B25B 13/04 81/186
9,168,643 B2 * 10/2015 Hsu ..... B25B 13/065
9,522,457 B2 * 12/2016 Huang ..... B25B 23/105
9,687,968 B2 * 6/2017 Doroslovac ..... B25B 13/08
9,718,170 B2 * 8/2017 Eggert ..... B25B 13/065
(Continued)

FOREIGN PATENT DOCUMENTS

WO WO-2015197276 A1 * 12/2015 ..... B25B 13/06

*Primary Examiner* — Joseph J Hail
*Assistant Examiner* — Jonathan R Zaworski
(74) *Attorney, Agent, or Firm* — Che-Yang Chen; Law Office of Michael Chen

(57) ABSTRACT

A ratchet socket may include a main body, and an outer periphery of the main body has ratchet teeth formed in an endless circular pattern to form the main body with a polygonal cross section. The main body comprises a hexagonal inner periphery to form six internal angles and six inner edges. Each of the inner edges has an engaging portion at a middle portion thereof, and each of the inner edges comprises two abutting portions at two sides of the engaging portion between the engaging portion and each of two adjacent internal angles. Each of two recess portions is formed between the engaging portion and the abutting portion to form two engaging teeth on two lateral edges of the engaging portion. Each of the internal angles is curved to form an inclined surface between the abutting portion and the adjacent internal angle.

3 Claims, 16 Drawing Sheets

(56) References Cited

U.S. PATENT DOCUMENTS

| | | | | |
|---|---|---|---|---|
| 9,757,844 | B2 * | 9/2017 | Chen | B25B 13/463 |
| 10,144,118 | B2 * | 12/2018 | Chang | B25B 13/08 |
| 10,442,060 | B2 * | 10/2019 | Eggert | B25B 13/065 |
| 10,596,685 | B2 * | 3/2020 | Lee | B25B 13/065 |
| 2004/0089106 | A1 * | 5/2004 | Wolfe | B25G 1/063 81/58.3 |
| 2008/0006126 | A1 * | 1/2008 | Hsieh | F16B 23/0061 81/121.1 |
| 2008/0245195 | A1 * | 10/2008 | Lee | B25B 27/18 81/124.6 |
| 2008/0307931 | A1 * | 12/2008 | Cheng | B25B 13/04 81/60 |
| 2009/0007732 | A1 * | 1/2009 | Hsieh | B25B 13/04 81/120 |
| 2009/0235788 | A1 * | 9/2009 | Hsieh | B25B 13/04 81/121.1 |
| 2010/0275738 | A1 * | 11/2010 | Taylor, Jr. | B25B 13/56 81/121.1 |
| 2016/0288300 | A1 * | 10/2016 | Chen | B25B 27/18 |
| 2017/0252905 | A1 * | 9/2017 | Doroslovac | B25B 13/065 |

* cited by examiner

RATCHET SOCKET

FIELD OF THE INVENTION

The present invention relates to a ratchet socket and more particularly to ratchet socket that is applied to different types of screws.

BACKGROUND OF THE INVENTION

A conventional tool such as ratchet wrench comprises a driving head (40) that has a hexagonal tool slot (41) (or clamp hole), and a user is adapted to engage the clamp slot with a lock unit (50) having a hexagonal head portion (51) and apply force to loosen or tighten the lock unit.

In order to engage easily with the head portion (51) of the lock unit (50), the inner diameter of the tool slot (41) of the driving head (40) is manufactured slightly larger than the indicated size, and the head portion (51) of the lock unit (50) is configured to have the outer diameter thereof slightly smaller than the indicated size, thereby engaging the driving head (40) with the lock unit (50) easily (as shown in FIGS. 14 to 16). However, although the larger inner diameter of the tool slot (41) and the smaller outer diameter of the head portion (51) can easily engage the driving head (40) and the lock unit (50) together, it also forms the larger gap between the tool slot (41) and the head portion (51) after coupled together. As a result, the slipping out may happen when the force applies on the driving head (40) to turn the head portion (51) of the lock unit (50) so as to damage the inner wall of the tool slot (41) and the head portion (51), leading to reducing the lifetimes of the lock unit (50) and the driving head (40).

Referring to FIGS. 17 to 19, in order to solve the problem mentioned above, there is a ratchet socket in the market comprising a socket (60), and an inner periphery of the socket (60) is formed into a hexagonal shape connecting hole (61) to engage with a screw unit. Each of six edges of the connecting hole (61) is formed into a connecting portion (62), and a middle portion of the connecting portion (62) has a stepped-shaped driving portion (621). When the socket (60) is used, the driving portion (621) forms an acute angle toward the counterclockwise direction, and the wall thickness of the connecting portion in the counterclockwise direction is thinner than that in the clockwise direction. Moreover, a plurality of connecting edges (63) are formed on an outer periphery of the socket (60), the length and the angle of each connecting edge (63) are the same. An opening of a tool is adapted to engage with the connecting edges (63) to enable the tool to provide torque, and the socket (60) is adapted to dispose on the screw unit, and the driving portion (621) of the connecting portion (62) is adapted to engage and rotate the screw unit, so as to loosen or tighten the screw unit.

However, the conventional ratchet socket has following disadvantages: (i) with the stepped-shaped driving portions (621), the normal and corresponding screw unit cannot be fitted, and the driving portions (621) can only be rotated in the counterclockwise direction, which greatly reduces consumer purchase intention; and (ii) the length and the angle of each connecting edge (63) of the socket (63) are the same, and when the opening of the tool is connected to the socket (60) to provide torque, the force is configured to apply on each corner of the connecting edge (63), and the wall thickness of the counterclockwise corners of the connecting portions (62) is relative thin due to the driving portions (621), so that it is easy to cause wear and fracture in the counterclockwise corner under the situation of torsion loosening, which results in poor durability and lack of practicality. Therefore, there remains a need for a new and improved design for a ratchet socket to overcome the problems presented above.

SUMMARY OF THE INVENTION

The present invention provides a ratchet socket which comprises a main body, and an outer periphery of the main body has ratchet teeth formed in an endless circular pattern to form the main body with a polygonal cross section. A flange is formed at an end of the main body, and the main body comprises a hexagonal inner periphery to form six internal angles and six inner edges, and the internal angles and the inner edges are alternately arranged at positions corresponding to the ratchet teeth at the outer periphery of the main body. Each of the inner edges has an engaging portion at a middle portion thereof, and each of the inner edges comprises two abutting portions at two sides of the engaging portion between the engaging portion and each of two adjacent internal angles. Each of two recess portions is formed between the engaging portion and the abutting portion to form two engaging teeth on two lateral edges of the engaging portion. Each of the internal angles is curved to form an inclined surface between the abutting portion and the adjacent internal angle.

In one embodiment, each of the engaging portions and two adjacent abutting portions at two sides of the engaging portion, which are on the same edge of the inner periphery of the main body, are formed on the same plane.

In another embodiment, the abutting portion and each of two adjacent inclined surfaces, which are on the same edge of the inner periphery of the main body, are not on the same plane with an inclination angle between 3 and 5 degree.

In still another embodiment, each of the ratchet teeth has a triangle cross section comprises a first side wall and a second side wall, and each of included angles on the top of the triangle between the first side wall and the second side wall are the same; the length of the first side wall is longer than that of the second side wall and for three consecutive ratchet teeth on the same side of the main body, the first side wall of the first ratchet tooth and the second side wall of the third ratchet tooth are not on the same plane with an inclination angle.

In a further embodiment, the inclination angle is between 2 and 3 degree.

Comparing with conventional ratchet socket, the present invention is advantageous because: (i) with the abutting portions and the inclined surfaces, the main body and the head portion of the screw have edge-edge contact, which prevents the damages on the screw and is more reliable in driving action; and (ii) the engaging portions are cooperated with the recess portions to couple on and dig up the edge of the head portion, and the scrap scraped off from the head portion is adapted to squeeze into the recess portions, so as to firmly engage the main body with the screw and achieve the screwing effect.

BRIEF DESCRIPTION OF THE DRAWINGS

FIG. 6-1 is a partial enlarged diagram illustrating the ratchet socket of the present invention is driven and an abutting portion thereof is abutted against a head portion of the screw.

FIG. 6-2 is a partial enlarged diagram illustrating the ratchet socket of the present invention is driven and n inclined surface is abutted against the head portion of the screw.

FIG. 7-1 is a partial enlarged diagram of FIG. 7.

FIG. 8-1 is a partial enlarged diagram of FIG. 8.

FIG. 9-1 is a partial enlarged diagram of FIG. 9.

FIG. 10-1 is a partial enlarged diagram of FIG. 10.

FIG. 11-1 is a partial enlarged diagram of FIG. 11.

FIG. 12-1 is a partial enlarged diagram of FIG. 12.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
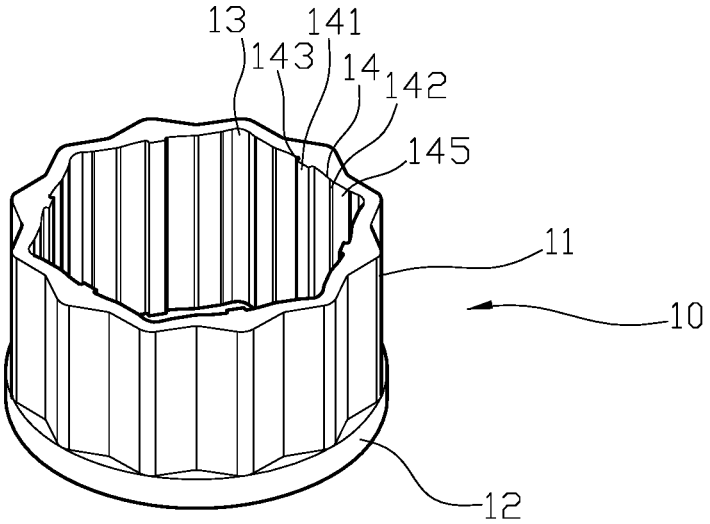
FIG. 1 is a three-dimensional assembly view of a ratchet socket of the present invention.
Figure 2:
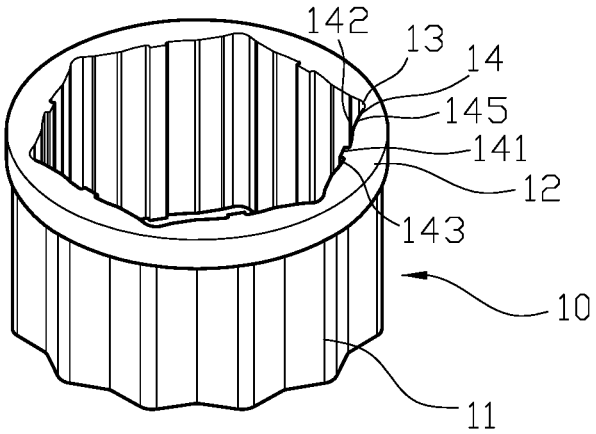
FIG. 2 is a three-dimensional assembly view from another angle of the ratchet socket of the present invention.
Figure 3:
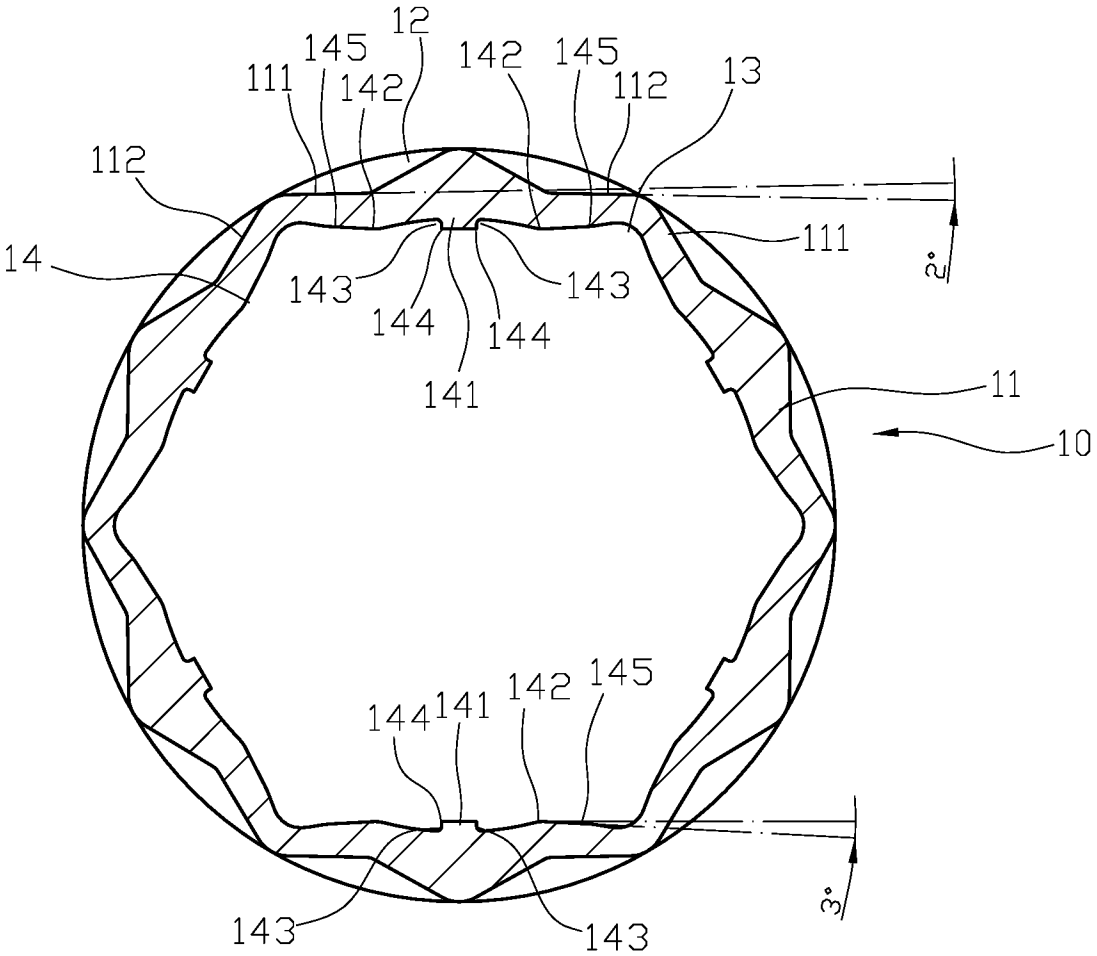
FIG. 3 is a sectional view of the ratchet socket of the present invention.

In order to further understand the goal, characteristics and effect of the present invention, a number of embodiments along with the drawings are illustrated as following:

Referring to FIGS. 1 to 3, the present invention provides a ratchet socket which comprises a main body (10), and an outer periphery of the main body (10) has ratchet teeth (11) formed in an endless circular pattern to form the main body (10) with a polygonal cross section. A flange (12) is formed at an end of the main body, and each of the ratchet teeth (11) has a triangle cross section comprises a first side wall (111) and a second side wall (112), and the angles respectively at tops of the triangles between the first side walls (111) and the second side walls (112) are the same. Moreover, the length of the first side wall (111) is longer than that of the second side wall (112), so that, for three consecutive ratchet teeth (11) on the same side of the main body (10), the first side wall (111) of the first ratchet tooth (11) and the second side wall (112) of the third ratchet tooth (11) are not on the same plane with an inclination angle from 2 to 3 degrees (as shown in FIG. 3). The main body (10) comprises a hexagonal inner periphery to form six internal angles (13) and six inner edges (14), and the internal angles (13) and the inner edges (14) are alternately arranged at positions corresponding to the ratchet teeth (11) at the outer periphery of the main body (10). Each of the inner edges (14) has an engaging portion (141) at a middle portion thereof, and each of the inner edges (14) comprises two abutting portions (142) respectively formed between the engaging portion (141) and the adjacent internal angle (13) at one side and between the engaging portion (141) and the adjacent internal angle (13) at the other side. Moreover, the top of the engaging portion (141) and the tops of the two abutting portions (142) are on the same plane, and each of two recess portions (143) is formed between the engaging portion (141) and the abutting portion (142) to form two engaging teeth (144) on two lateral edges of the engaging portion (141). Each of the internal angles (13) is curved to form an inclined surface (145) between the abutting portion (142) and the adjacent internal angle (13), and the abutting portion (142) and each of two adjacent inclined surfaces (145), which are on the same edge of the inner periphery of the main body (10), are not on the same plane with an inclination angle between 3 and 5 degree (as shown in FIG. 3).

Figure 4:
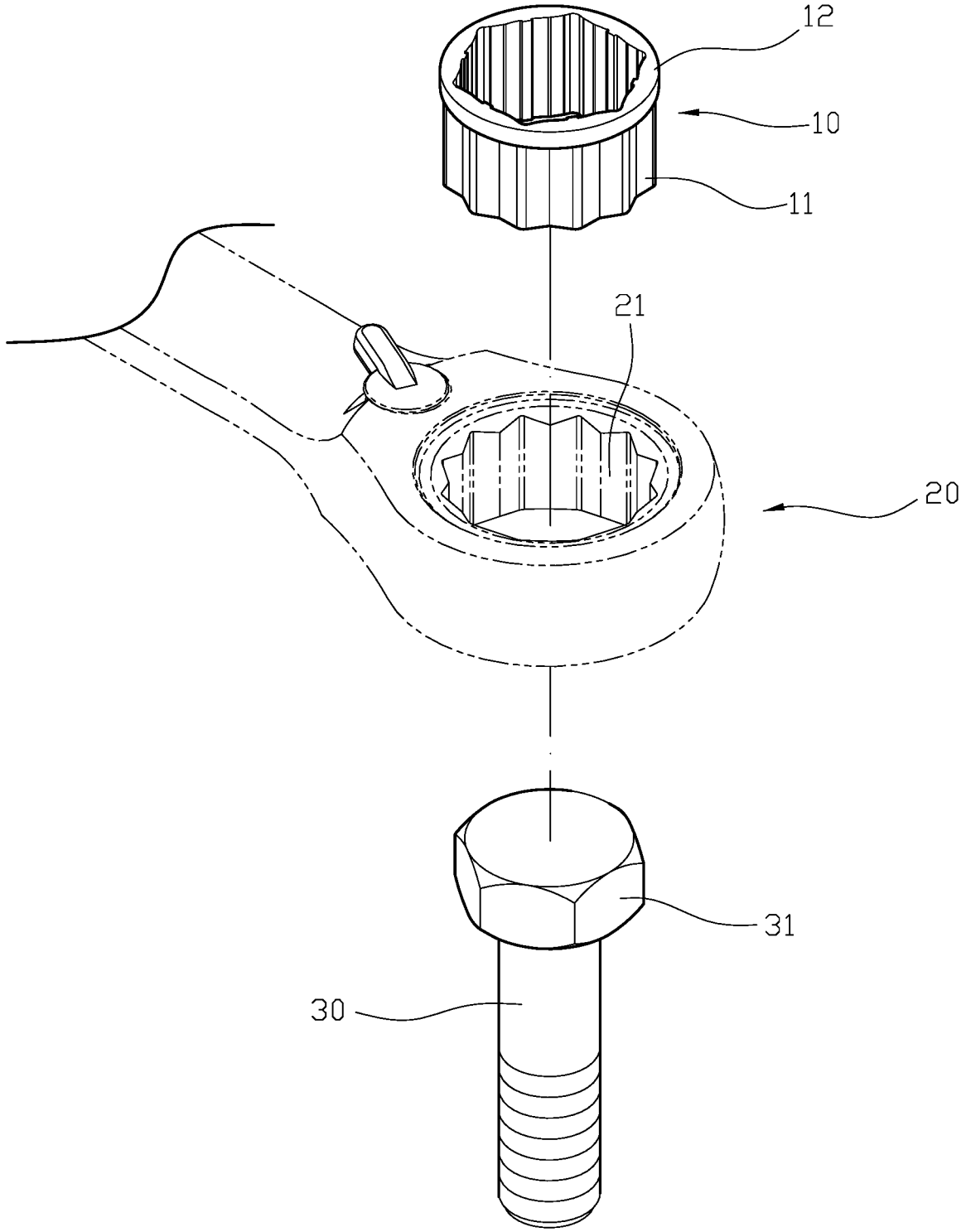
FIG. 4 is an exploded assembly view illustrating the ratchet socket of the present invention is in use.
Figure 5:
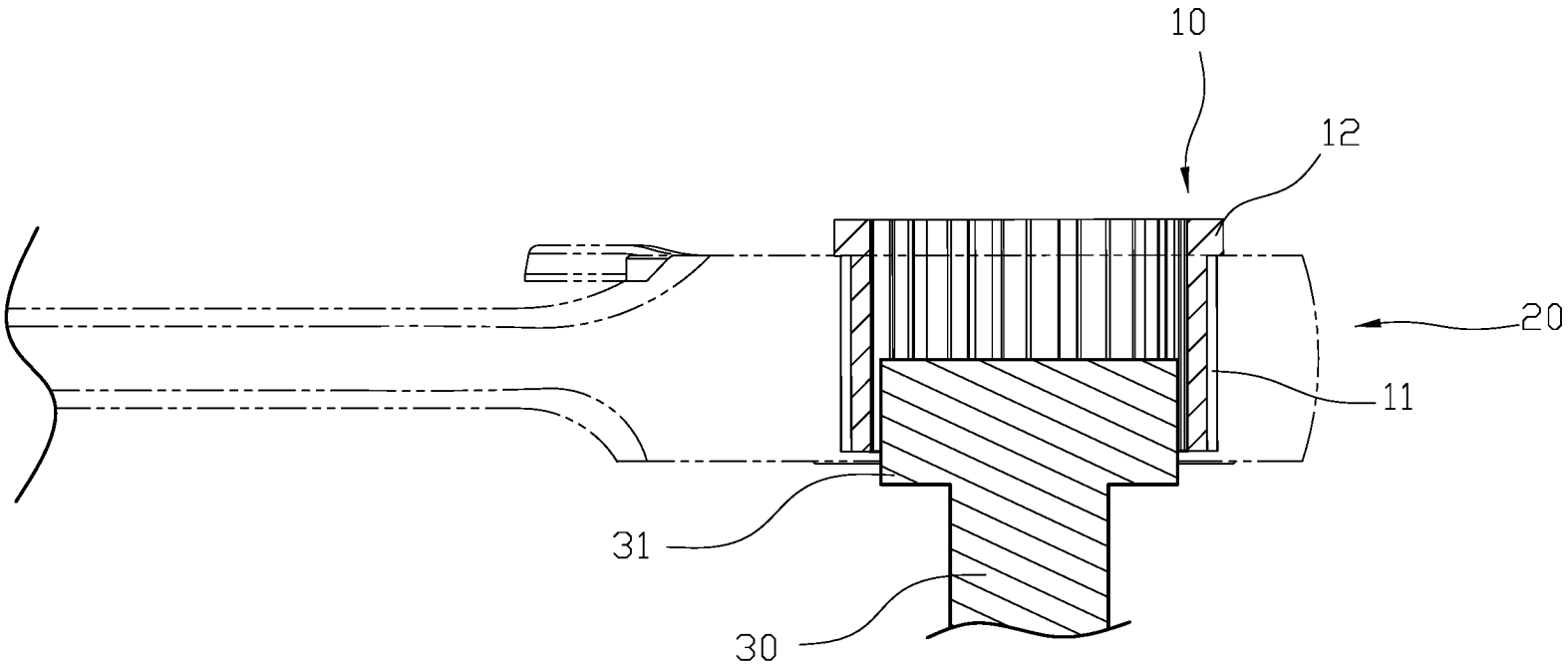
FIG. 5 is a sectional view illustrating the ratchet socket of the present invention is in use.

In actual application, referring to FIGS. 4 and 5, the main body (10) is cooperated with a tool (20) such as ratchet wrench for use, and the main body (10) is coupled in an engaging hole (21) of the tool (20), and the flange (12) is coupled with an open edge of the engaging hole (21) to secure the position of the main body (10) with the tool (20). Thus, the tool (20) can drive the main body (10) to tighten or loosen a screw (30).

Figures 1, 6:
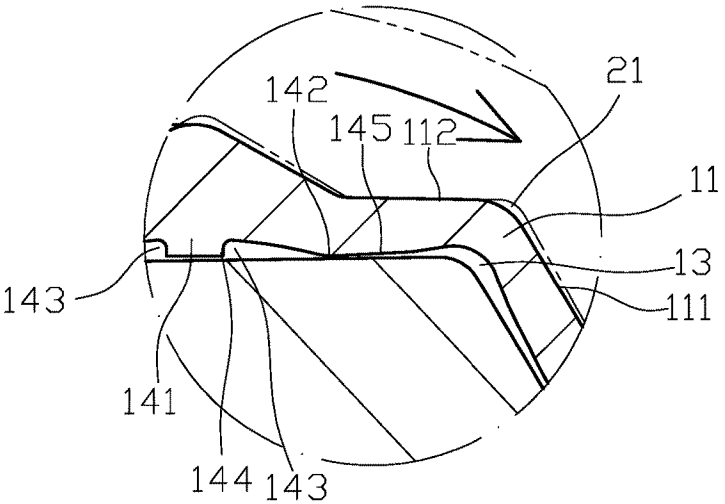
FIG. 6 is a schematic view illustrating the ratchet socket of the present invention is adapted to tighten a normal screw.
Figures 2, 6:
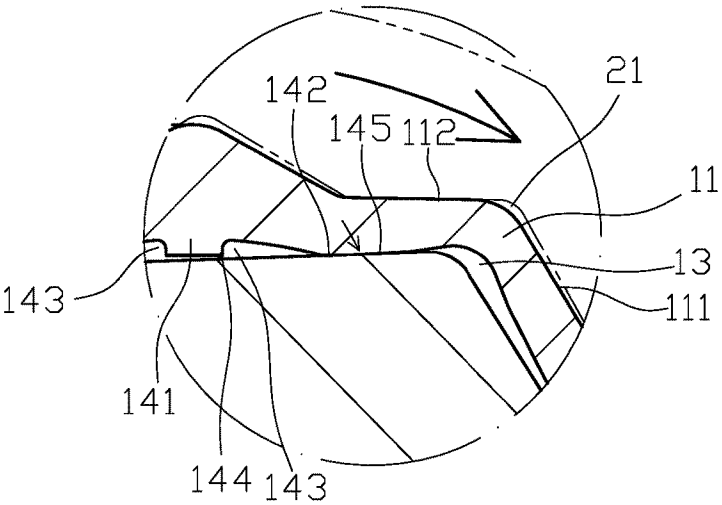
Figure 6:
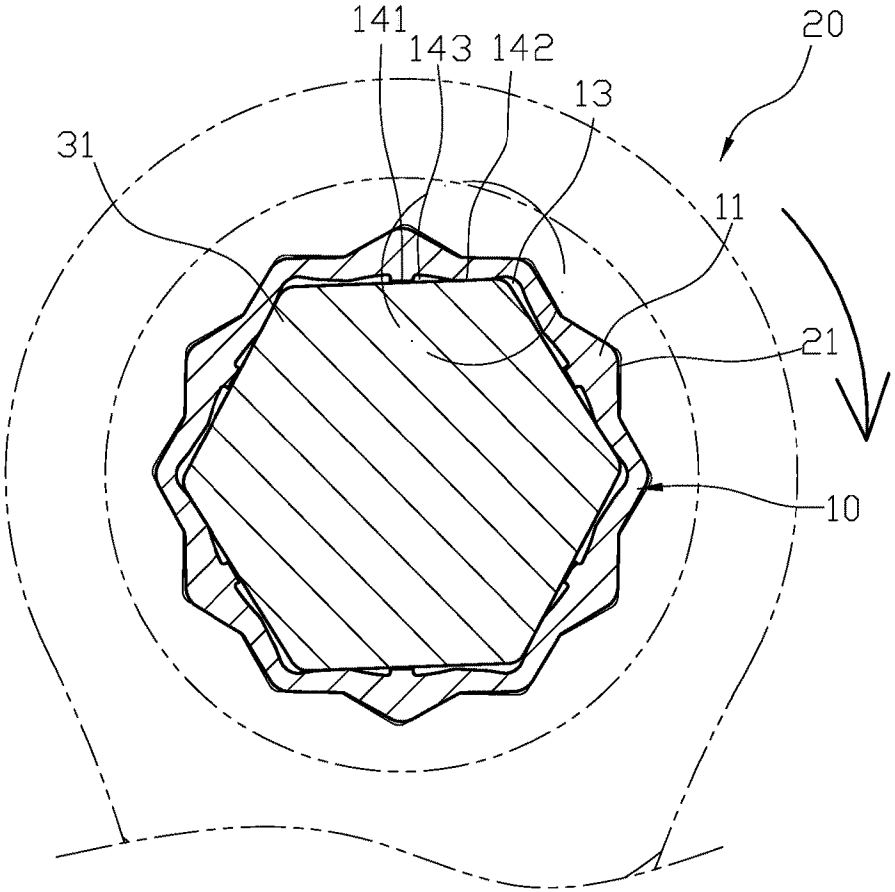
Figures 1, 7:
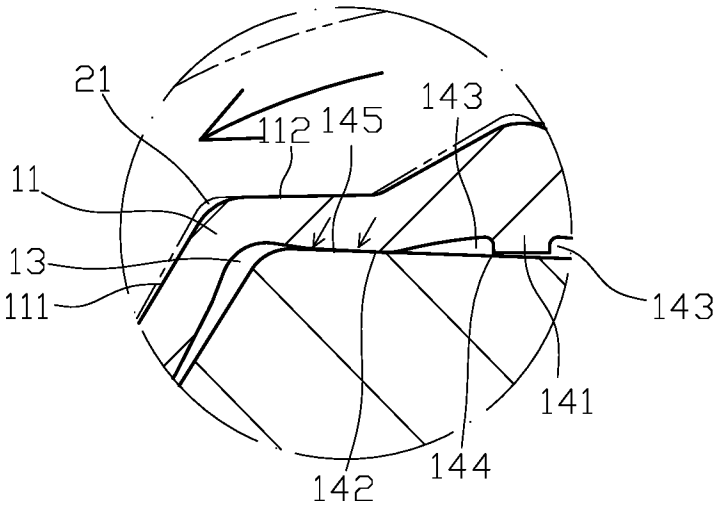
FIG. 7 is a schematic view illustrating the ratchet socket of the present invention is configured to loosen a normal screw.
Figure 7:
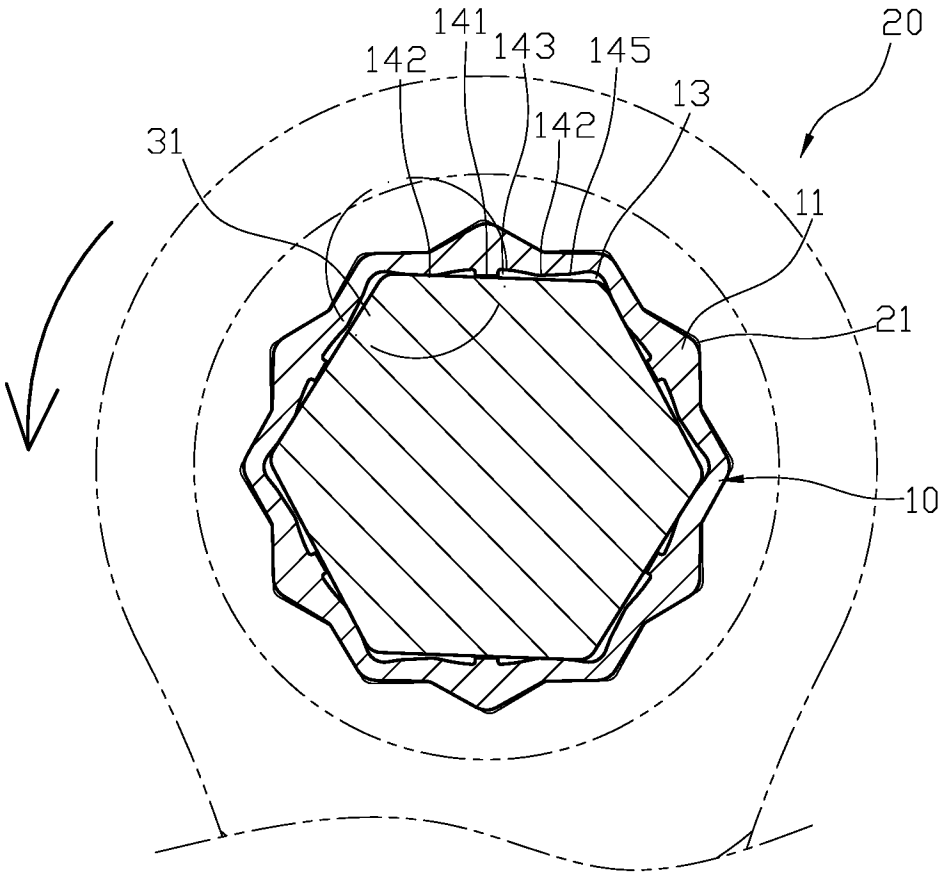

Referring to FIGS. 6, 6-1, and 6-2, in case that the screw (30) is adapted to be locked, and the inner diameter of the main body (10) is slightly larger than a head portion (31) of the screw (30). When the tool (20) with the main body (10) is rotated in clockwise direction to lock the screw (30), each of the abutting portions (142) on the right side of the inner edge (14) is configured to abut against each of edges of the head portion (31) of the screw (30) at a quarter position thereof, and the inclined surfaces (145) are abutted against the edges of the head portion (31) respectively so as to firmly rotate and lock the screw (30). Moreover, the internal angles (13) have no contact with corners of the head portion (31) of the screw (30) so as to prevent the corners of the head portion (31) from being damaged due to instantaneous torque force.

Figures 1, 8:
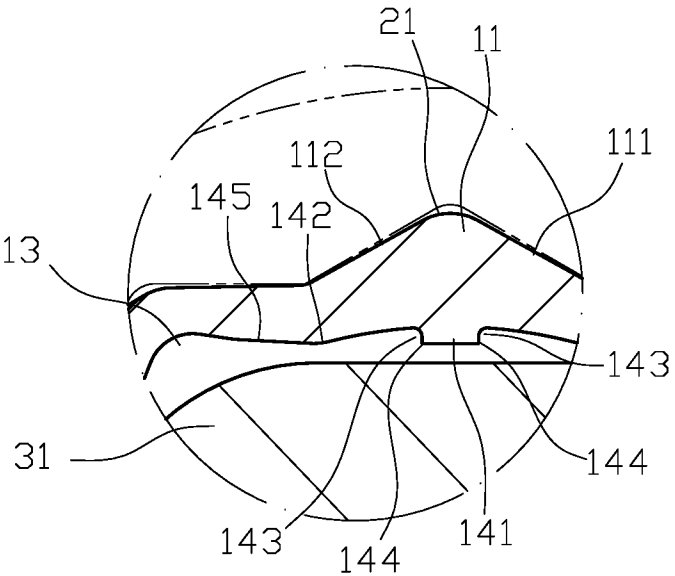
FIG. 8 is a sectional view illustrating the ratchet socket of the present invention is applied to the stripped of head portion of the screw.
Figure 8:
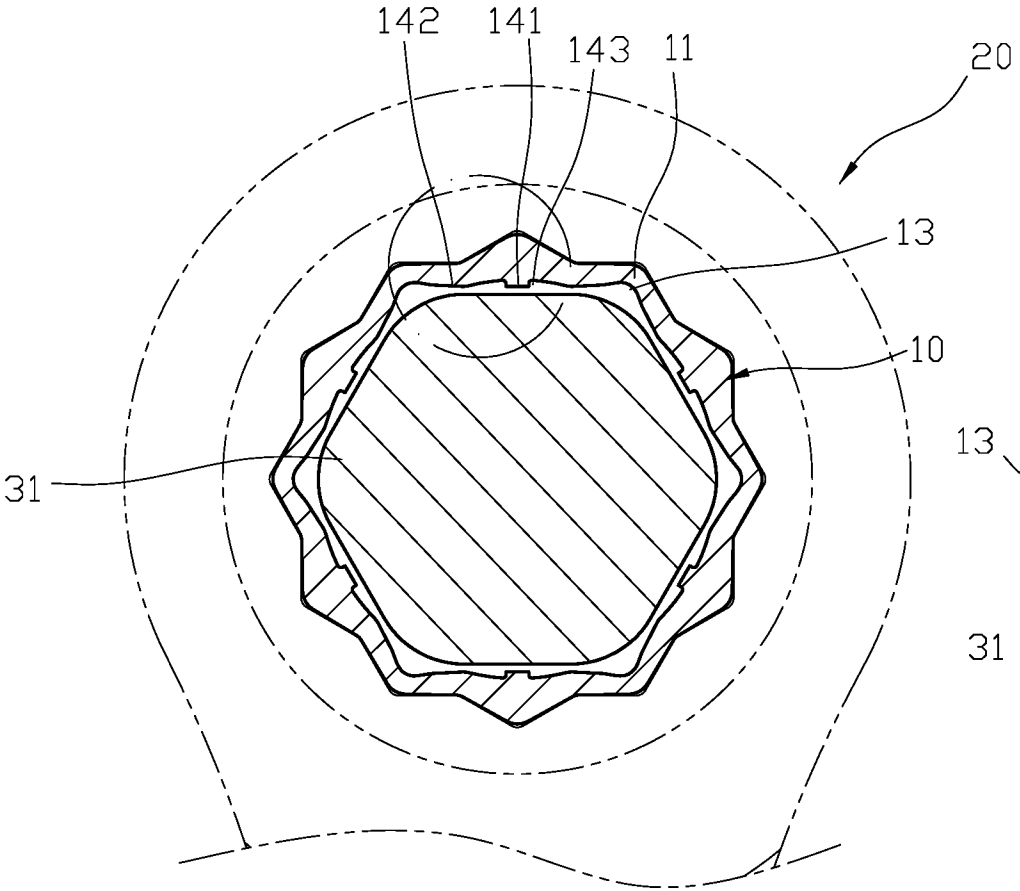
Figures 1, 9:
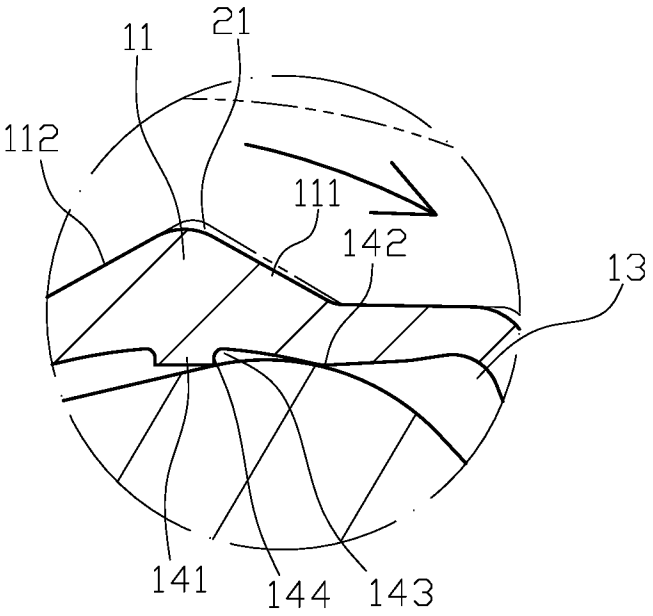
FIG. 9 is a schematic view illustrating the ratchet socket of the present invention is configured to tighten the stripped of head portion of the screw.
Figure 9:
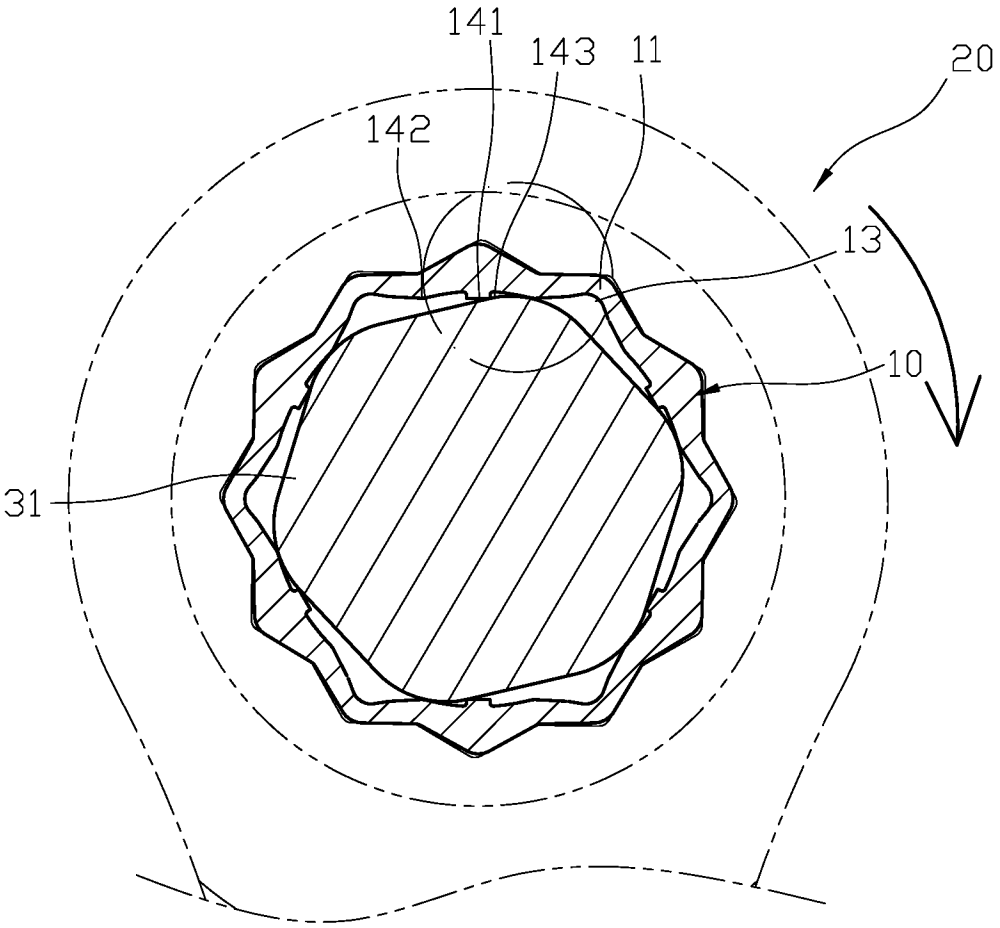
Figures 1, 10:
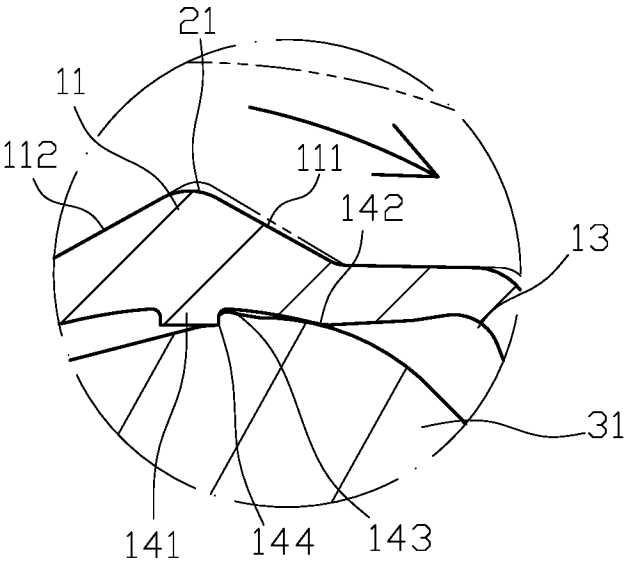
FIG. 10 is another schematic view illustrating the ratchet socket of the present invention is configured to tighten the stripped of head portion (31) of the screw.
Figure 10:
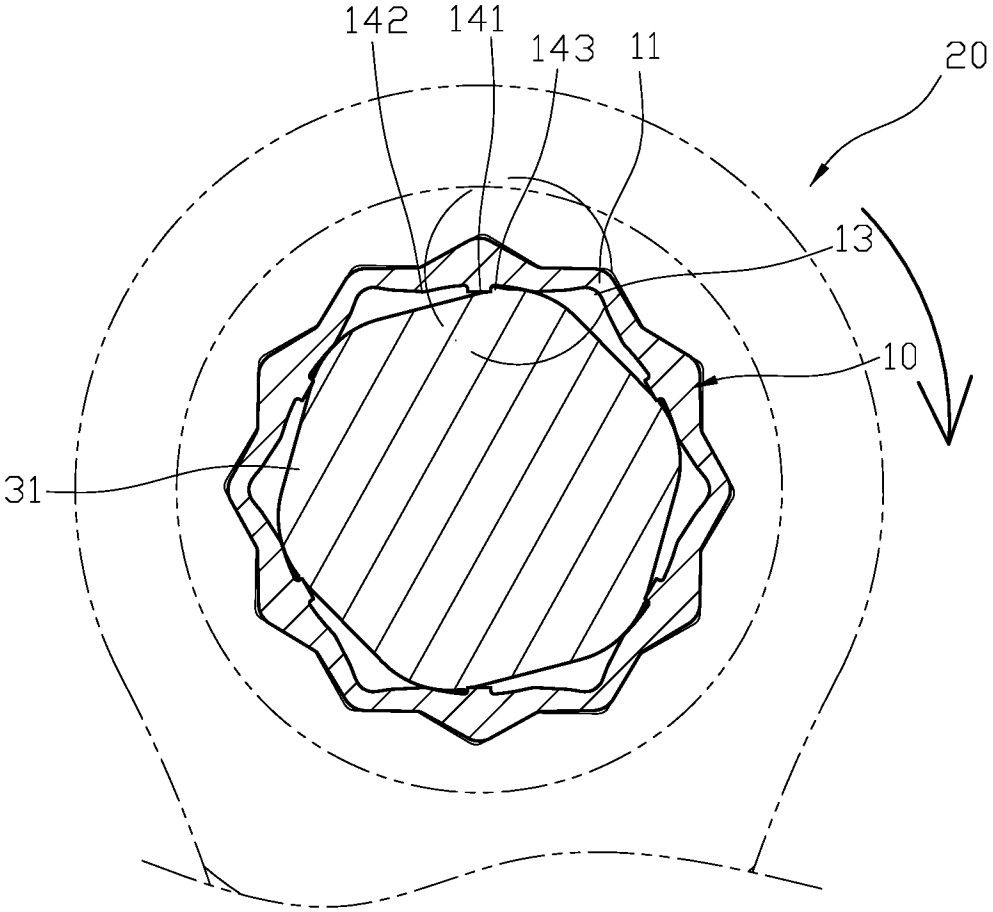

On the contrary, referring to FIG. 8, in case that the screw (30) is configured to be unscrewed, the tool (20) with the main body (10) is rotated in counterclockwise direction, and each of the abutting portions (142) on the left side of the inner edge (14) is adapted to abut against each of the edges of the head portion (31) of the screw (30) at three-quarter position thereof, and the inclined surfaces (145) are abutted against the edges of the head portion (31) respectively so as to firmly rotate and unscrew the screw (30).

Additionally, the first side wall (11.1) and the second side wall (112) of the ratchet tooth (11) are not formed in the same length, so that a plurality of gaps are formed between the main body (10) and the engaging hole (21) when the main body (10) disposed in the engaging hole (21) of the tool (20). When the tool (20) is rotated, driving teeth on an inner periphery of the engaging hole (21) are not tightly engaged with the ratchet teeth (11) of the main body (10), and with the gaps between the engaging hole (21) and the main body (10), the tops of the ratchet teeth (11) are adapted to dodge tops of the driving teeth of the engaging hole (21) so as to use edges thereof for force transmission, thereby increasing the contact areas between the main body (10) and the tool (20) and prevent the damage on the ratchet teeth (11).

Furthermore, referring to FIGS. 8, 8-1, 9, 9-1, 10 and 10-1, the main boy (10) can be applied to the stripped of head portion (31) of the screw (30). In case that the corners of the head portion (31) of the screw (30) are worn into arc shape and each of the edges of the head portion (31) has the reduction of volume due to wear. When the screw (30) is adapted to be locked, and the tool (20) with the main body (10) is rotated in clockwise direction to lock the screw (30), and each of the engaging portions (141) on the middle portion of the inner edge (14) is adapted to engage with the arc portion of the head portion (31), and the engaging tooth (144) on the right side of the engaging portion (141) is configured to couple on and dig up the edge of the head portion (31), and the scrap scraped off from the head portion (31) is adapted to squeeze into the recess portion (143) on the right side of the engaging portion (141), so as to firmly engage the main body (10) with the screw (30) and achieve the screwing effect.

Figures 1, 11:
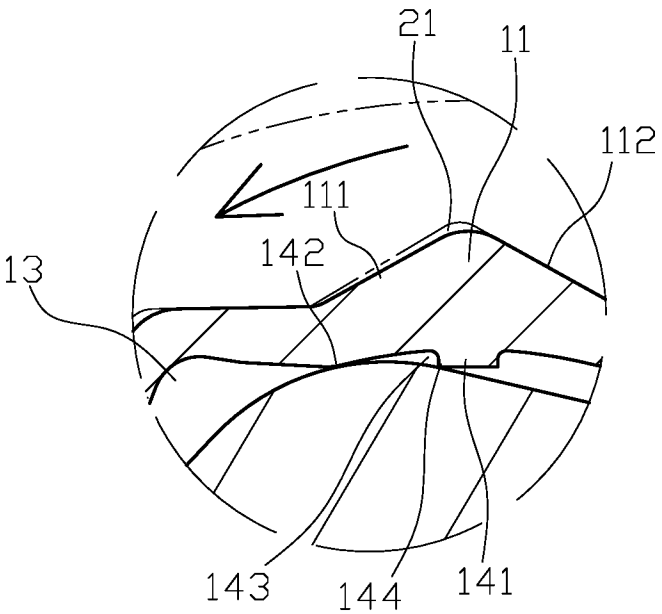
FIG. 11 is a schematic view illustrating the ratchet socket of the present invention is configured to loosen the stripped of head portion of the screw.
Figure 11:
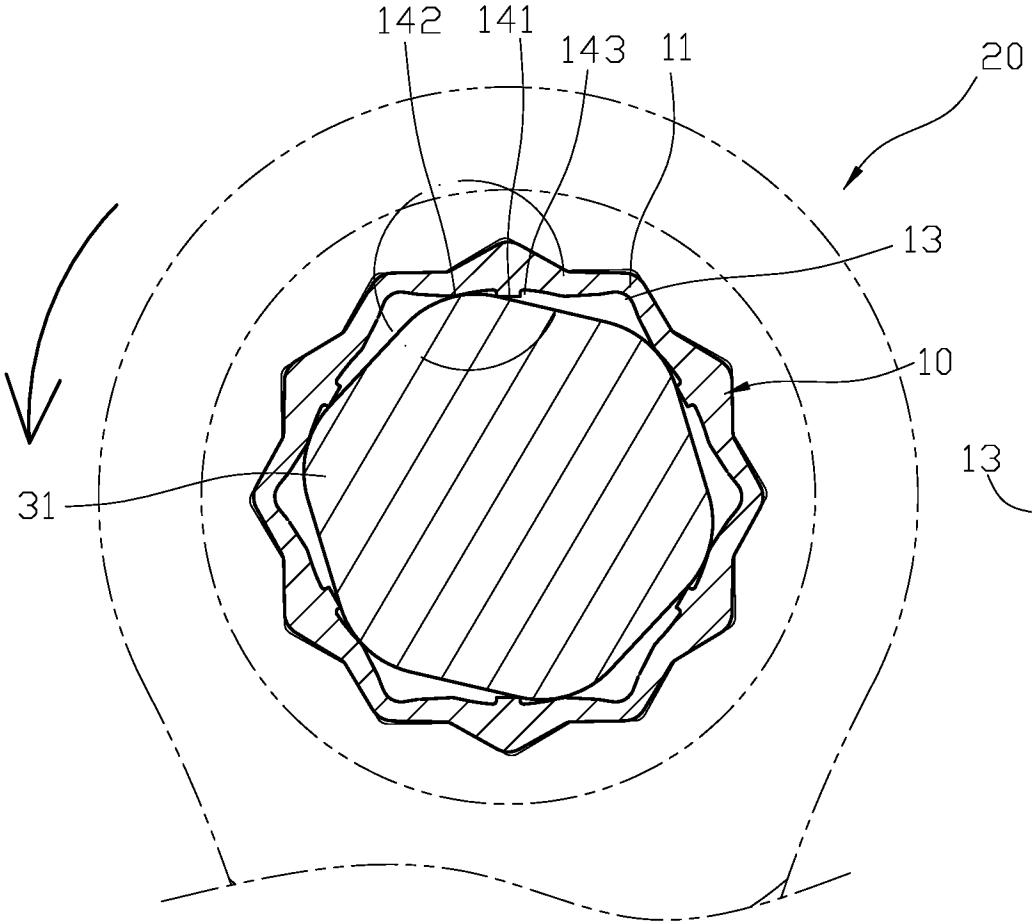
Figures 1, 12:
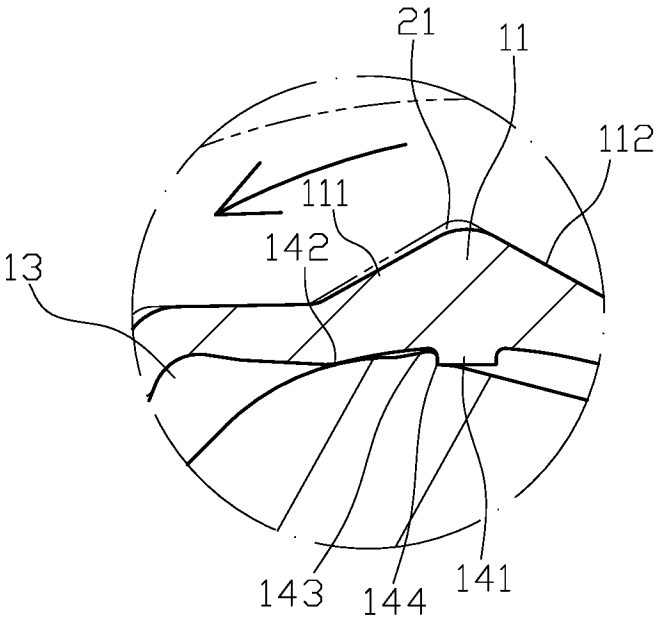
FIG. 12 is another schematic view illustrating the ratchet socket of the present invention is configured to loosen the stripped of head portion of the screw.
Figure 12:
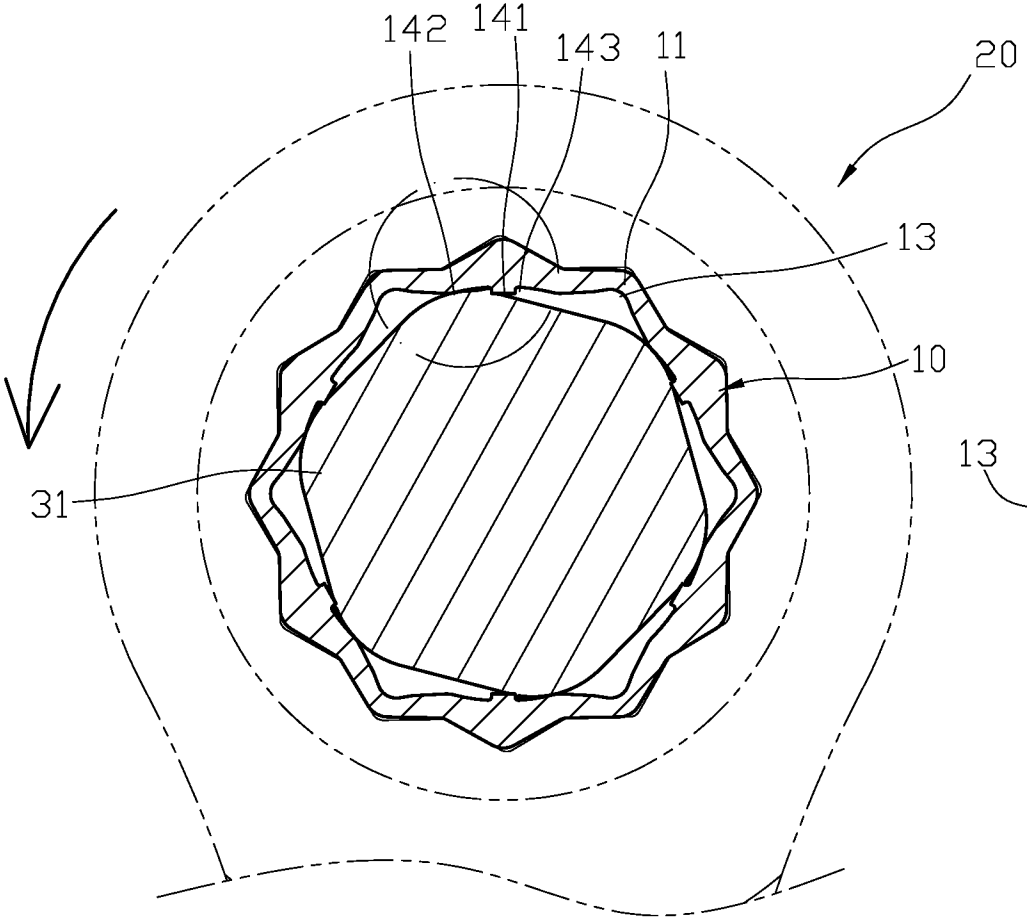

Conversely, when the stripped of head portion (31) of the screw (30) needs to be unscrewed out, referring to FIGS. 11, 11-1, 12, and 12-1, the tool (20) with the main body (10) is rotated in counterclockwise direction, and each of the engaging portions (141) on the middle portion of the inner edge (14) is adapted to engage with the arc portion of the head portion (31), and the engaging tooth (144) on the left side of the engaging portion (141) is configured to couple on and dig up the edge of the head portion (31), and the scrap scraped off from the head portion (31) is adapted to squeeze into the recess portion (143) on the left side of the engaging portion (141), so as to firmly engage the main body (10) with the screw (30) and achieve the screwing effect.

Figure 13:
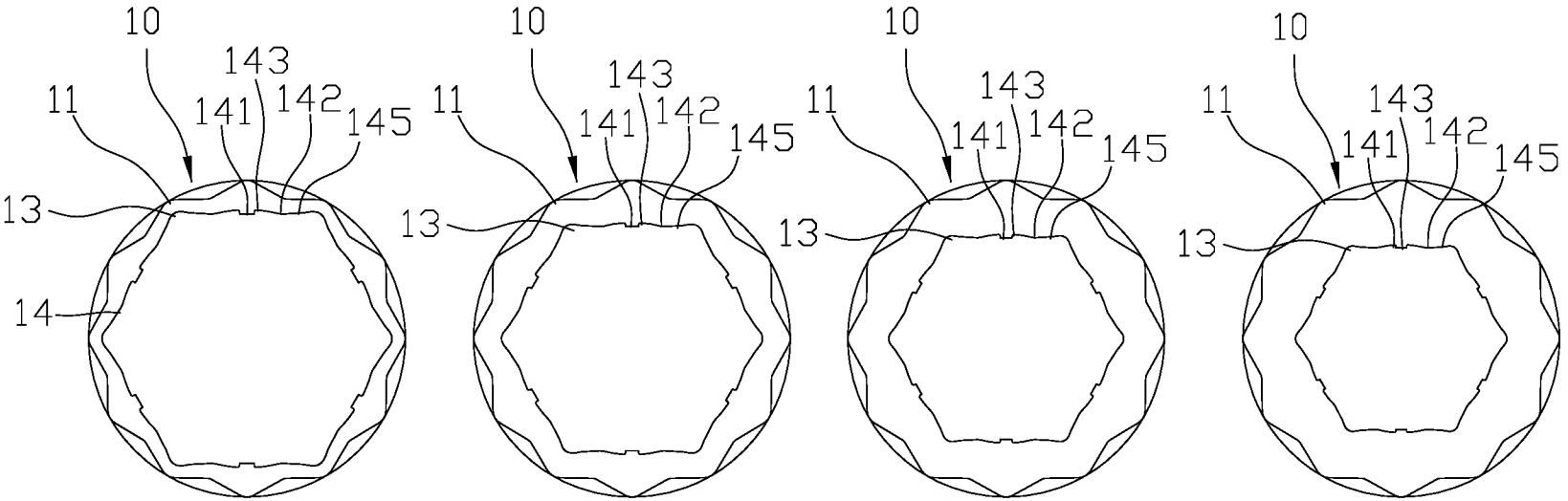
FIG. 13 is a schematic view illustrating the main body is made with different sizes of the inner diameters to apply to different sizes of the head portions of the screws.
Figure 14:
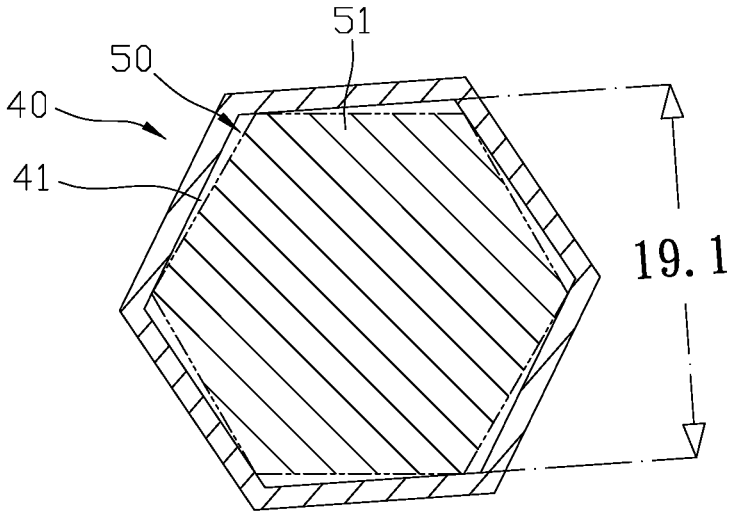
FIG. 14 PRIOR ART
FIG. 14 is a prior art.
Figure 15:
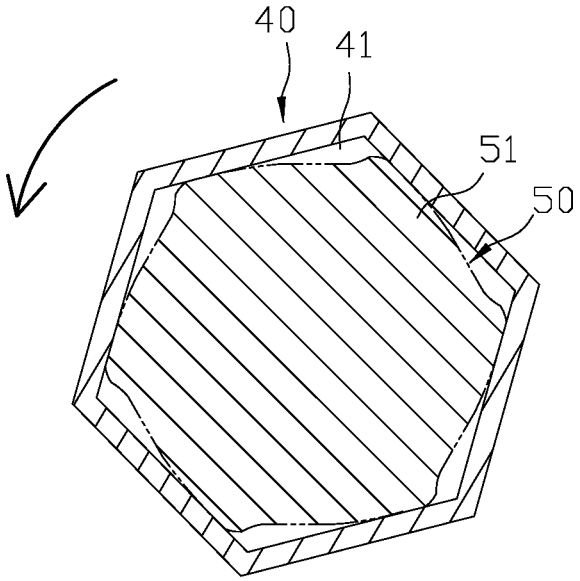
FIG. 15 PRIOR ART
FIG. 15 is a prior art.
Figure 16:
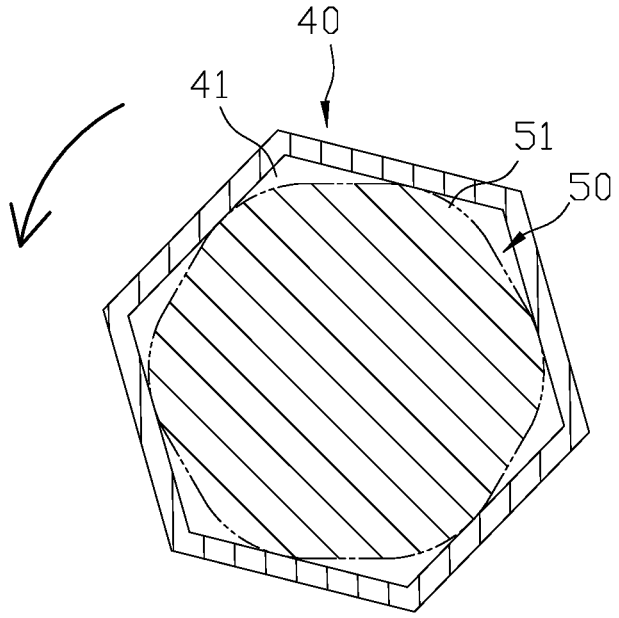
FIG. 16 PRIOR ART
FIG. 16 is a prior art.
Figure 17:
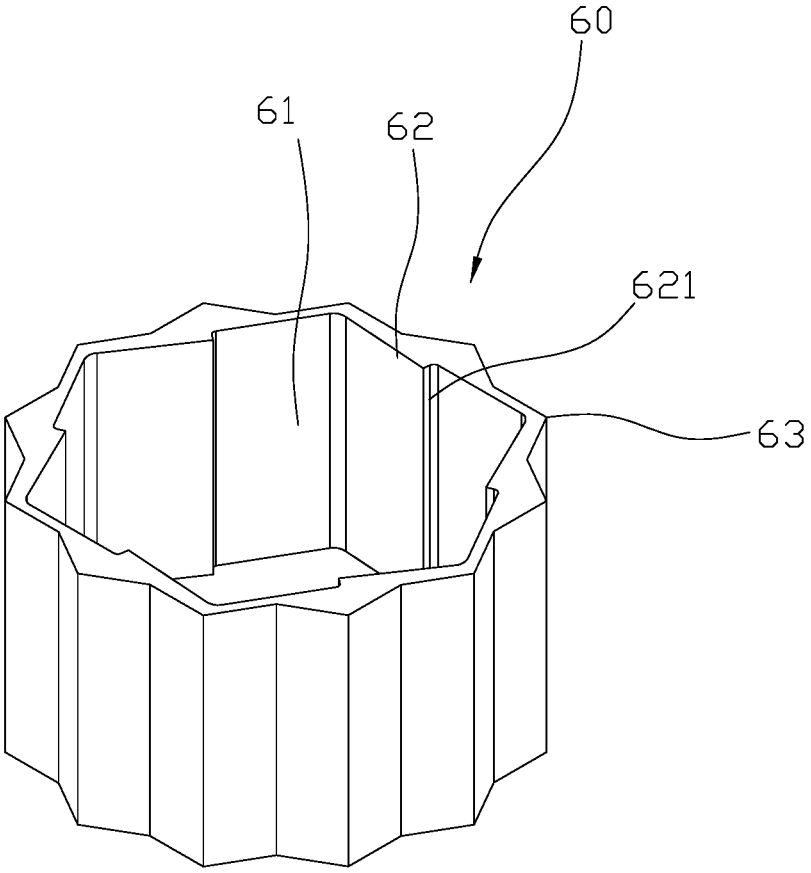
FIG. 17 PRIOR ART
FIG. 17 is a prior art.
Figure 18:
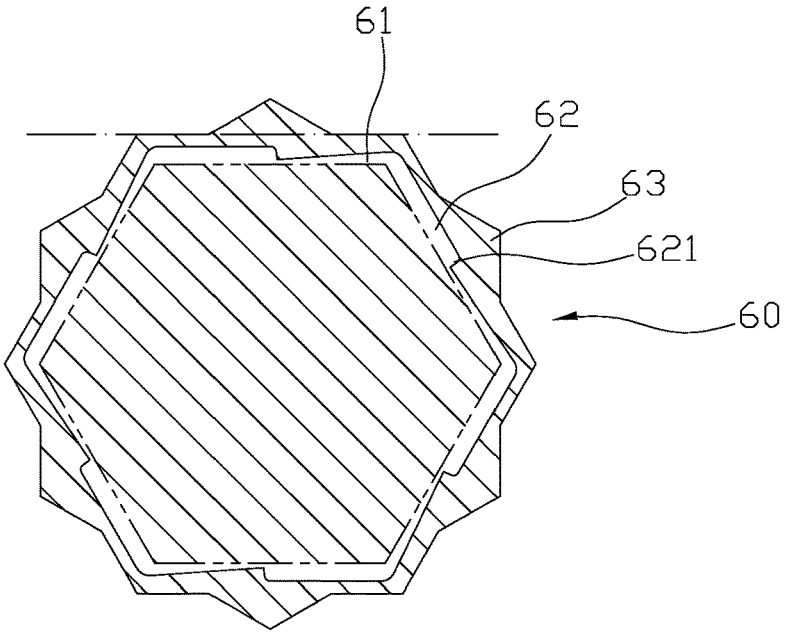
FIG. 18 PRIOR ART
FIG. 18 is a prior art.
Figure 19:
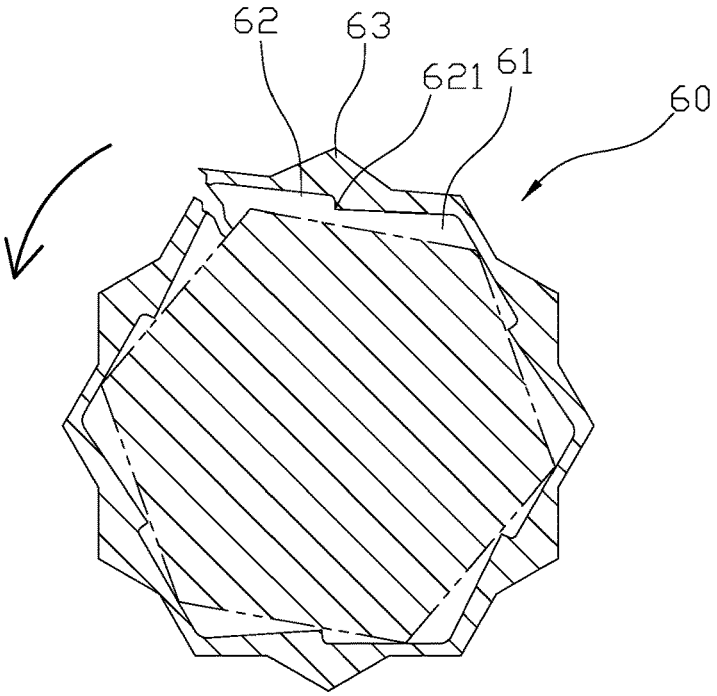
FIG. 19 PRIOR ART
FIG. 19 is a prior art.

In one embodiment, the main body (10) is made with different sizes of the inner diameters to apply to different sizes of the head portions (31) of the screws (30) (as shown in FIG. 13).

Comparing with conventional ratchet socket, the present invention is advantageous because: (i) with the abutting portions (142) and the inclined surfaces (145), the main body (10) and the head portion (31) of the screw (30) have edge-edge contact, which prevents the damages on the screw (30) and is more reliable in driving action; and (ii) the engaging portions (141) are cooperated with the recess portions (143) to couple on and dig up the edge of the head portion (31), and the scrap scraped off from the head portion (31) is adapted to squeeze into the recess portions (143), so as to firmly engage the main body (10) with the screw (30) and achieve the screwing effect.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A ratchet socket comprising a main body, and an outer periphery of the main body having ratchet teeth formed in an endless circular pattern to form the main body with a polygonal cross section; a flange formed at an end of the main body, and the main body comprising a hexagonal inner periphery to form six internal angles and six inner edges, and the internal angles and the inner edges alternately arranged at positions corresponding to the ratchet teeth at the outer periphery of the main body; each of the inner edges having an engaging portion at a middle portion thereof, and each of the inner edges comprising two abutting portions at two sides of the engaging portion between the engaging portion and each of two adjacent internal angles; each of two recess portions formed between the engaging portion and the abutting portion to form two engaging teeth on two lateral edges of the engaging portion; and each of the internal angles curved to form an inclined surface between the abutting portion and the adjacent internal angle, wherein each of the ratchet teeth has a triangle cross section comprises a first side wall and a second side wall, and each of included angles on the top of the triangle between the first side wall and the second side wall are the same; the length of the first side wall is longer than that of the second side wall, and for three consecutive ratchet teeth on the same side of the main body, the first side wall of the first ratchet tooth and the second side wall of the third ratchet tooth are not on the same plane with an inclination angle, and the inclination angle is between 2 and 3 degrees.

2. The ratchet socket of claim 1, wherein each of the engaging portions and two adjacent abutting portions at two sides of the engaging portion, which are on the same edge of the inner periphery of the main body, are formed on the same plane.

3. The ratchet socket of claim 1, wherein the abutting portion and each of two adjacent inclined surfaces, which are on the same edge of the inner periphery of the main body, are not on the same plane with an inclination angle between 3 and 5 degrees.

* * * * *